United States Patent [19]

Derby et al.

[11] Patent Number: 4,759,473

[45] Date of Patent: Jul. 26, 1988

[54] COLLAPSIBLE RECEPTACLE WITH INTEGRAL SLING

[75] Inventors: Norwin C. Derby, Denison; Robert R. Williamson, Dallas, both of Tex.

[73] Assignee: Super Sack Manufacturing Corporation, Dallas, Tex.

[21] Appl. No.: 577,489

[22] Filed: Feb. 6, 1984

Related U.S. Application Data

[63] Continuation of Ser. No. 336,456, Dec. 31, 1981, abandoned, which is a continuation-in-part of Ser. No. 281,406, Jul. 8, 1981, abandoned, which is a continuation of Ser. No. 46,822, Jun. 8, 1979, abandoned.

[51] Int. Cl.[4] ..... B65D 33/38

[52] U.S. Cl. ..... 222/105; 222/181; 222/529; 383/24; 383/67; 383/906

[58] Field of Search ..... 383/6, 24, 7, 41, 121, 383/62, 67, 71, 48, 906; 222/105, 107, 92, 181, 185, 528, 530; 229/17 B

[56] References Cited

U.S. PATENT DOCUMENTS

| | | | |
|---|---|---|---|
| 2,322,688 | 6/1943 | Glick | 383/6 |
| 3,132,794 | 5/1964 | Frazier | 383/7 |
| 4,081,011 | 3/1978 | Krause | 383/24 |

FOREIGN PATENT DOCUMENTS

| | | | |
|---|---|---|---|
| 2512014 | 9/1976 | Fed. Rep. of Germany | 383/41 |
| 100838 | 11/1962 | Norway | 383/7 |
| 1317398 | 5/1973 | United Kingdom | 383/24 |

*Primary Examiner*—H. Grant Skaggs
*Attorney, Agent, or Firm*—Michael A. O'Neil

[57] ABSTRACT

A collapsible receptacle (10) for handling flowable materials in semi-bulk quantities includes integral sling structure. The receptacle (10) comprises side panels (30, 32, 34 and 36), a top panel (48) including a fill spout (52), and a bottom panel (58). Lift sleeves (38, 40) are formed in an opposing pair of side panels (34, 36) for supporting the receptacle (10) without an external sling arrangement or pallet. In another embodiment, the receptacle (120) includes bands (122) of continuous filaments woven into two side panels (34'', 36'') for additional strength. In another embodiment, the receptacle (150) is formed from a receptacle blank (158) comprised of one piece of material. Another feature of the invention is the reinforced bottom panel (124) construction.

6 Claims, 7 Drawing Sheets

COLLAPSIBLE RECEPTACLE WITH INTEGRAL SLING

CROSS REFERENCE TO RELATED APPLICATIONS

This application is a continuation of prior application Ser. No. 336,456, filed Dec. 31, 1981, now abandoned, which is a continuation-in-part of prior application Ser. No. 281,406, filed July 8, 1981, now abandoned, which is in turn a continuation of application Ser. No. 046,822, filed June 8, 1979, now abandoned.

TECHNICAL FIELD

The present invention relates in general to receptacles for material handling. More particularly, this invention concerns a collapsible receptacle with an integral sling which is useful in handling flowable materials in semi-bulk quantities.

BACKGROUND ART

The handling of particulate, granular or other flowable materials involves several problems. Such materials include chemicals, minerals, fertilizers, foodstuffs, grains, agricultural products and the like. Materials like these have generally been handled in two fashions. Bulk handling equipment, including railroad cars, barges, trucks and the like, is employed when large quantities of material are required. Such bulk handling equipment, however, is of limited versatility. Only large quantities of materials can be handled efficiently, and only at those locations accessible to such equipment. In addition, sanitary standards are more difficult to maintain with bulk handling equipment because the materials are often exposed during at least part of the handling.

Container systems have been developed for handling relatively smaller quantities of material. The containers are individually filled, loaded for transportation to a point of distribution or use, unloaded, opened and emptied. Although containers can be more convenient in some respects, higher handling costs are usually incurred because less material is carried per container. The return freight costs of reusable containers can be substantial, particularly for rigid or noncollapsible containers.

There has been increasing interest in the use of flexible, collapsible containers for handling semi-bulk quantities of materials. The advantages of such receptacles include relatively low weight, reduced cost, better versatility, and low return freight costs in the case of reusable receptacles. One disadvantage of some flexible receptacles, however, is that they are not self-supporting and must therefore be handled with the aid of pellets or the like. Other flexible receptacles incorporate external sling assemblies for purposes of self-support. Two successful examples of receptacles with external sling constructions can be found in U.S. Pat. Nos. 4,113,146 and 4,143,796 to Williamson and Williamson and Derby, respectively.

The incorporation of a sign assembly into a flexible receptacle, however, complicates the construction thereof in that the sling must be fashioned separately and then secured to the receptacle. Collapsible receptacles having external slings thus tend to be more expensive. There is thus a need for an improved collapsible receptacle of reduced cost which is self-supporting without an external sling arrangement.

DISCLOSURE OF INVENTION

The present invention comprises a material receptacle which overcomes the foregoing and other difficulties associated with the prior art. The invention comprises a new and improved collapsible receptacle for handling materials in semi-bulk quantities. The receptacle features top loading and bottom discharge. The receptacle herein can be used with virtually any flowable material, including minerals, chemicals, fertilizers, foodstuffs, agricultural products and the like. The receptacle of the present invention can be sized to handle from about six to eighty-four cubic feet of material, or up to about 3,000 pounds by weight. The construction of the receptacle herein functions as an integral sling, whereby an external sling assembly is neither desirable nor necessary. The invention lends itself simplified construction, and is therefore less expensive than collapsible receptacles incorporating external sling assemblies.

More specifically, the present invention comprises a collapsible receptacle with a built-in sling. The receptacle is formed primarily of rectangular panels of flexible but substantially inextensible material. Woven polypropylene or woven polyethylene materials can be utilized in constructing the invention. The receptacle herein includes a number of side panels, two of which are relatively longer than the other side panels. The side panels are arranged and secured together along the side edges thereof. The longer side panels are folded back and secured to themselves to form opposing lift loops or sleeves extending substantially the width of the receptacle. A bottom panel is secured between the bottom edges of the side panels, while a top panel with a fill spout therein is secured between the top edges of the side panels. If desired, a discharge spout can be mounted in the bottom panel.

In another embodiment of the invention, reinforced material is utilized for the two side panels having the lift sleeves at the tops thereof. The reinforced material comprises woven polypropylene or woven polyethylene with continuous longitudinal strands of polyester woven directly therein. The reinforcing polyester strands can be provided in the material as selvage or bands.

In another aspect of the invention, a combination top/bottom panel assembly can be used in constructing the receptacle. The assembly includes a panel with an opening positioned centrally therein. The opening is preferably oblong or oval in shape and is at least as wide in the long direction as the maximum bridging distance of the material being handled. A spout is positioned in the opening and secured to the panel. The assembly can be used in this form as a top panel for the receptacle. To convert to a bottom panel construction, a closure assembly is secured to the panel about the spout.

In yet another embodiment of the invention, the receptacle is formed from a single piece of material. Preferably, a receptacle blank is formed by making predetermined cutouts through a length of flattened circular or tubular material. The forward and trailing ends of the receptacle blank correspond so that blanks can be cut sequentially from an advancing supply of tubular material without waste. Openings for the fill and discharge spouts are cut into the receptacle blank as desired. The blank is then folded and secured to form a collapsible receptacle with an integral sling.

In still another embodiment of the invention, it has been found to be most effective for collapsible receptacles of woven polypropylene or woven polyethylene materials with a sling to sew the sling to the top of the side panels with 5 stitches per inch. A lower stitch of 3½ stitches per inch between the sling and side panels approximately 6 inches below the first stitch is then provided.

In yet another embodiment of the present invention, any sewed seams in a collapsible receptacle of woven polypropylene or polyethylene are made by folding over each edge to be sewed and gluing the folded section to form a double thickness of material. The seams are then sewed between the double thickness of material for increased strength.

BRIEF DESCRIPTION OF DRAWINGS

A more complete understanding of the invention can be had by reference to the following Detailed Description in conjunction with the accompanying Drawings, wherein.

Figure 7:
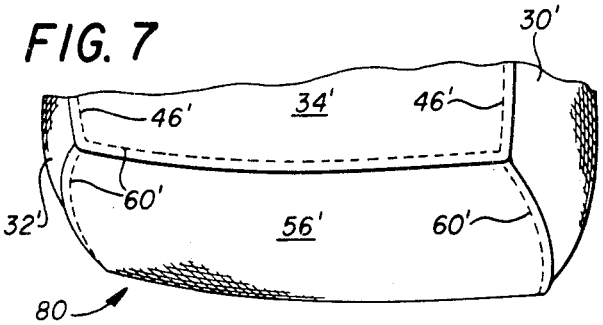
Figure 6D:
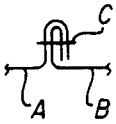
Figure 8:
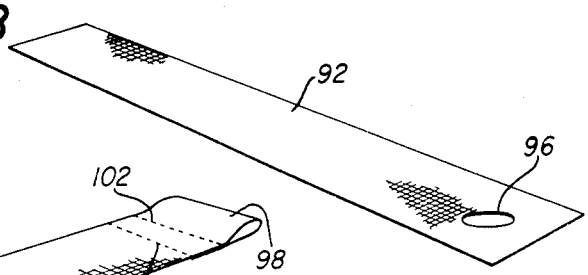
Figure 9:
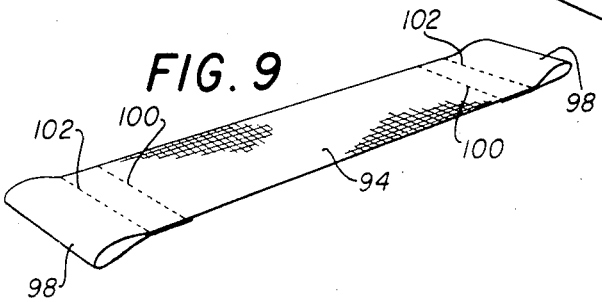
Figure 12:
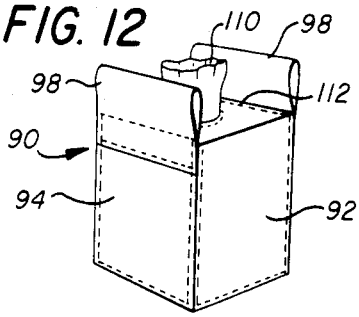
Figure 13:
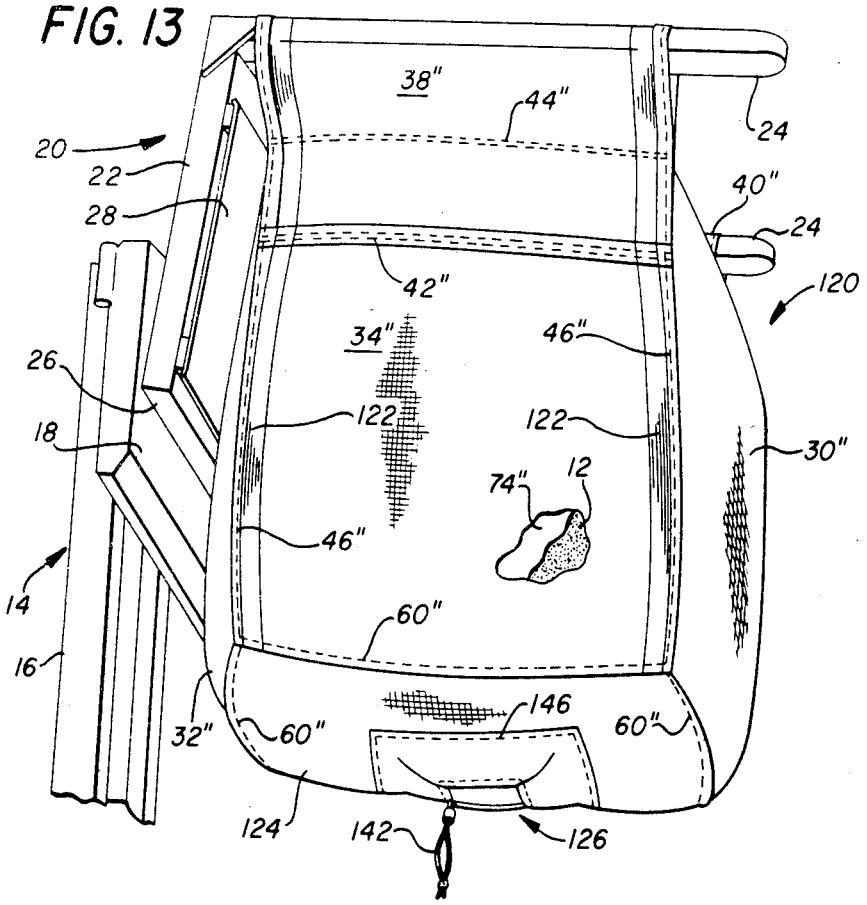
Figure 14:
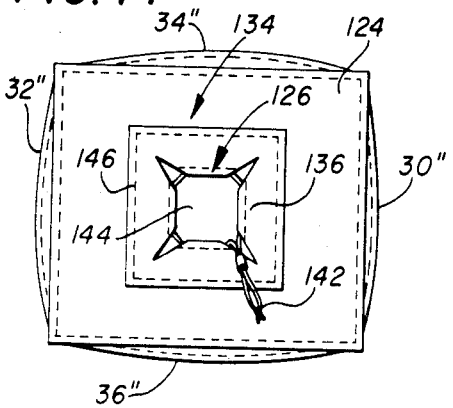
Figure 15:
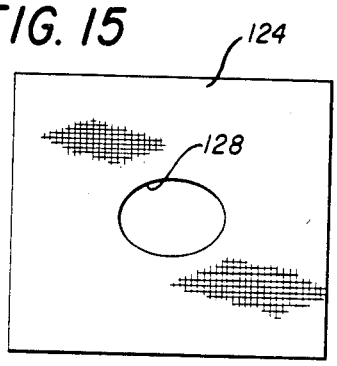
Figure 23:
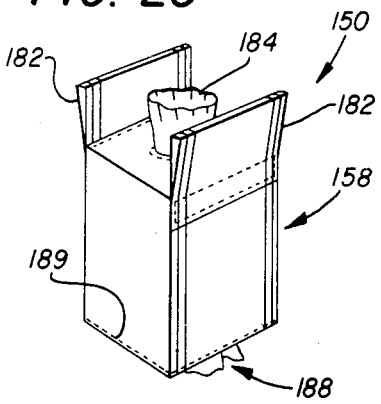
Figure 24:
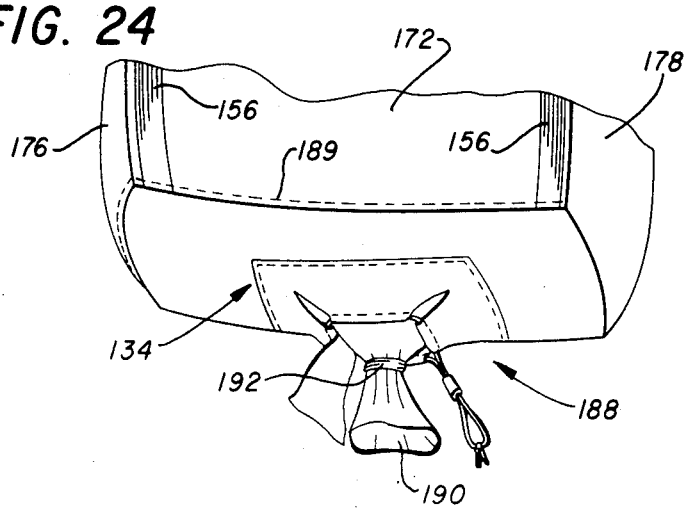
Figure 25:
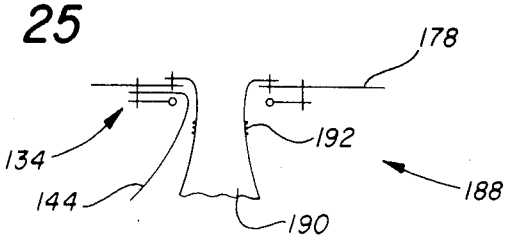
Figure 26:
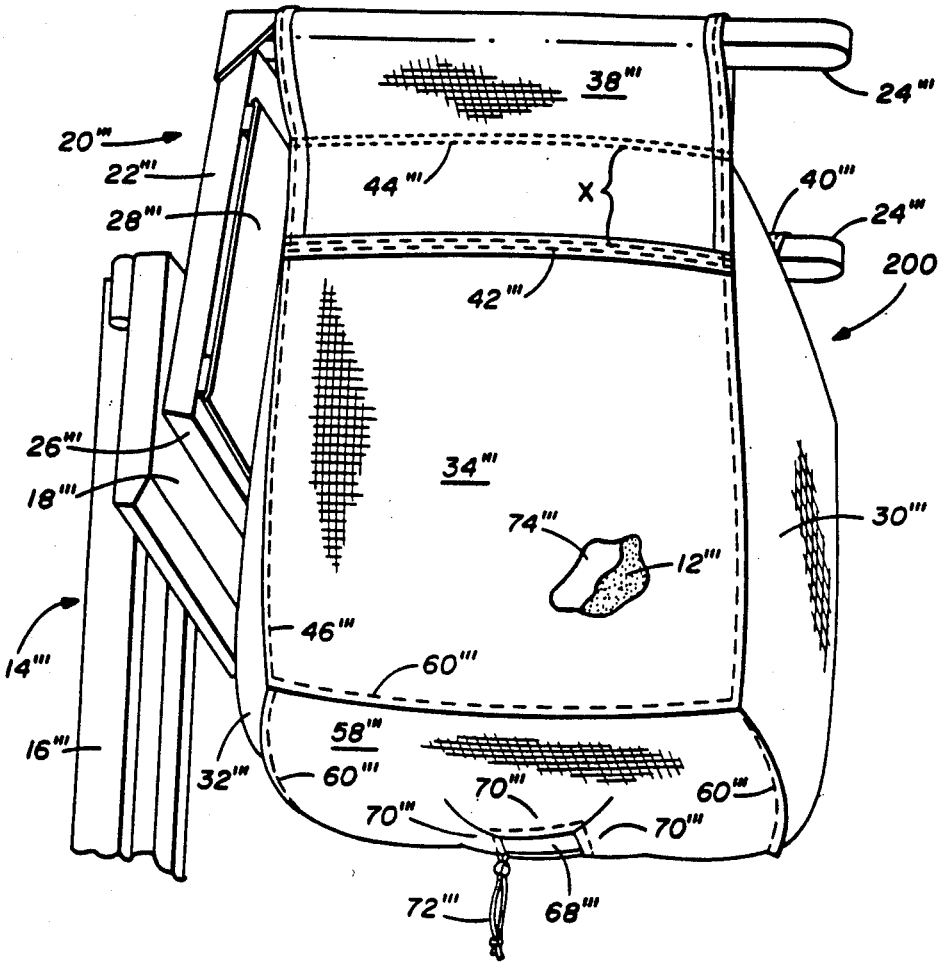
Figure 27:
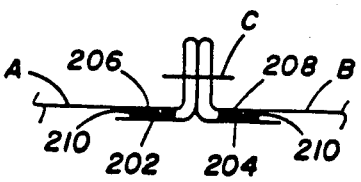

FIG. *6a, 6b, 6c* and *6d* are diagrams of two types of seam utilized in constructing the invention;

FIG. 7 is a partial bottom side perspective view of a collapsible receptacle incorporating a second embodiment of the invention;

FIGS. 8–11 illustrate steps in constructing a third embodiment of the invention;

FIG. 12 is a perspective illustration of a collapsible receptacle incorporating the third embodiment of the invention;

FIG. 13 is a bottom side perspective view of a collapsible receptacle incorporating a fourth embodiment of the invention;

FIG. 14 is a bottom view of the receptacle shown in FIG. 13;

FIGS. 15–18 are detail illustrations showin construction of the bottom receptacle panel;

FIGS. 19–22 illustrate steps in constructing a fifth embodiment of the invention;

FIG. 23 is a perspective illustration of a collapsible receptacle incorporating the fifth embodiment of the invention;

FIG. 24 is a partial perspective view of the receptacle shown in FIG. 23 with the discharge spout assembly extended;

FIG. 25 is a diagrammatic vertical section view through the extended discharge spout assembly of FIG. 24;

FIG. 26 is a bottom side perspective view of a collapsible receptacle incorporating a first modification of the first embodiment of the invention; and FIG. 27 is a diagram of another type of seam utilized in constructing the invention.

DETAILED DESCRIPTION

Figure 1:
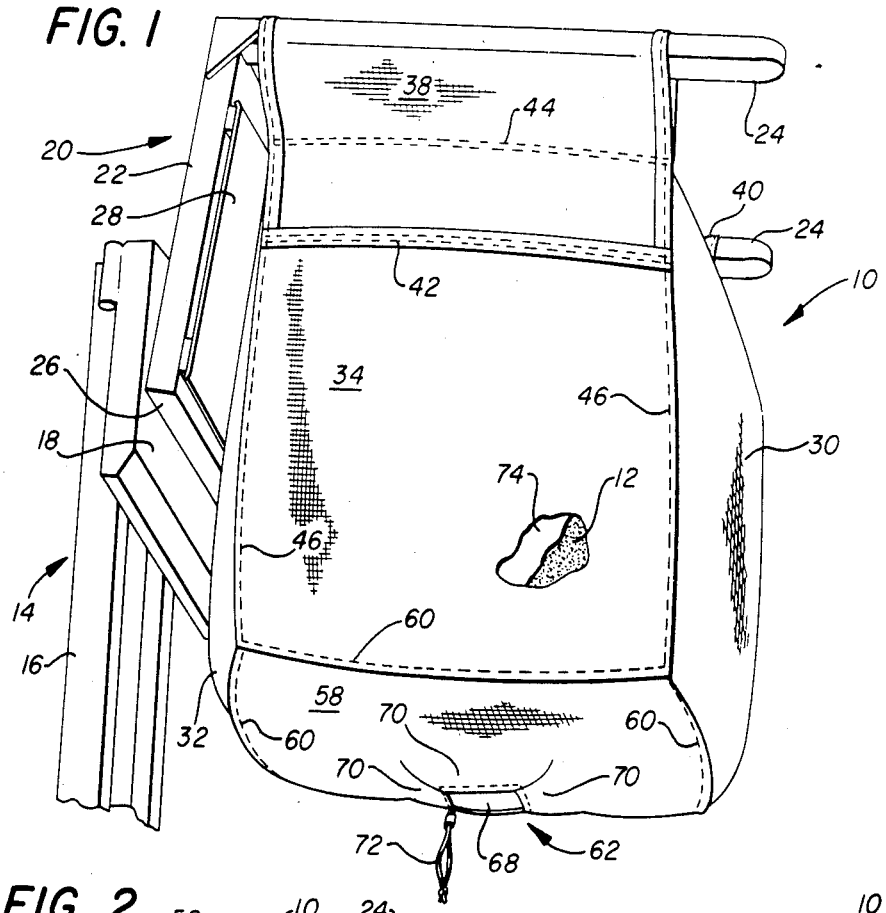
FIG. 1 is a bottom side perspective view of a collapsible receptacle incorporating a first embodiment of the invention.

Referring now to the Drawings, wherein like reference numerals designate like or corresponding parts throughout the several views, and particularly referring to FIGURE 1, there is shown a receptacle 10 incorporating a first embodiment of the invention. The receptacle 10 is of flexible, collapsible construction and is useful in handling semi-bulk quantities of material 12. For example, material 12 can comprise minerals, chemicals, fertilizers, foodstuffs, agricultural products or the like.

A forklift assembly 14 supports the receptacle 10 in FIG. 1. Forklift assembly 14 includes a mast 16 on a conventional forklift vehicle (not shown). Mast 16 supports a cross member 18 which is vertically movable along the mast. Other loading vehicles having different types of lift assemblies can also be utilized.

A fork attachment 20 is connected to the cross member 18. Attachment 20 includes two vertical columns 22 and arms 24 extending outwardly from the upper ends of the columns 22. A plate 28 is secured over crossbars 26. Portions of receptacle 10 are received over arms 24 for support by fork attachment 20.

If desired, receptacle 10 can be lifted and carried by a crane or the like using an attachment having arms similar to arms 24 in fork attachment 20. Receptacle 10 is self-supporting, and no external sling assemblies or pallets are required to handle the receptacle.

Figure 2:
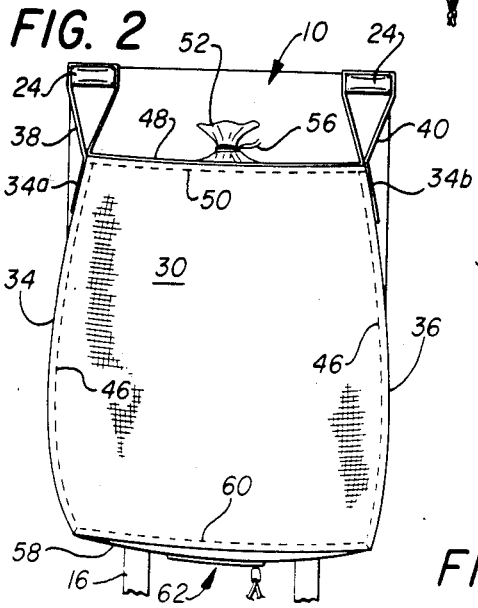
FIG. 2 is a reduced front view of the receptacle shown in FIG. 1.
Figure 3:
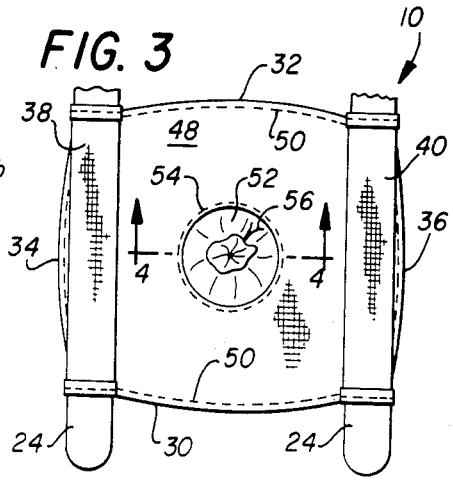
FIG. 3 is a reduced top view of the receptacle shown in FIG. 1.
Figure 4:
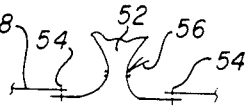
FIG. 4 is a diagrammatic sectional view taken along lines 4—4 of FIG. 3 in the direction of the arrows.

Constructional details of receptacle 10 are shown in FIGS. 1, 2 and 3. Receptacle 10 comprises front and back side panels 30 and 32, and left and right side panels 34 and 36. Side panels 30, 32, 34 and 36 are all generally rectangular. In accordance with the preferred construction of receptacle 10, side panels 34 and 36 are relatively longer than side panels 30 and 32. The upper ends of side panels 34 and 36 are folded back and secured to themselves to form lift sleeves 38 and 40, respectively. Lift sleeves 38 and 40 thus extend the entire width of side panels 34 and 36, respectively.

In particular, the formation of lift sleeves 38 and 40 proceeds as follows. Each lift sleeve 38 and 40 is formed similarly. With respect to panel 34, the top edge thereof is secured by stitching 42 extending across the panel. Preferably, a second line of stitching 44 is provided across panel 34 above stitching 42. If desired, the top and side edges of panel 34 can be folded inward before provision of stitching 42 and 44 for extra reinforcement of these areas in receptacle 10. It has been found that the two lines of stitching 42 and 44 create a truss-like effect, which is more effective in distributing load between lift sleeve 38 and receptacle 10. Lift sleeve 40 in side panel 36 is formed in similar fashion. It will thus be understood that lift sleeves 38 and 40 extending across the entire width of receptacle 10 are formed directly in an opposing pair of side panels.

The side panels 30, 32, 34 and 36 are joined at the side edges thereof to form an upstanding sidewall in receptacle 10. The side edges of the panels are connected together by means sewn seams 46. Seams, such as plain seams wherein adjacent panels are joined by stitching along a line positioned inwardly from the free edges of the panels, can be used to interconnect each panel 30, 32, 34 and 36 to an adjacent panel. Other suitable types of seams 46 can also be used, if desired. The side panels 30, 32, 34 and 36 are thus interconnected by longitudinal seams 46 extending along the length thereof.

A top panel 48 is secured between the upper ends of side panels 30, 32, 34 and 36. Panel 48 can be of rectangular or square configuration. Panel 48 is secured about the periphery thereof to side panels 30, 32, 34 and 36 by means of stitching 50. A fill spout 52 is mounted in an opening provided centrally in the top panel 48. The spout 52 is generally cylindrical, and is secured by stitching 54 about the circumference of one end to panel 48. A wire tie 56 or other suitable device can be employed to close fill spout 52. It will thus be apparent that flowable material 12 is introduced into receptacle 10 through fill spout 52.

Figure 5:
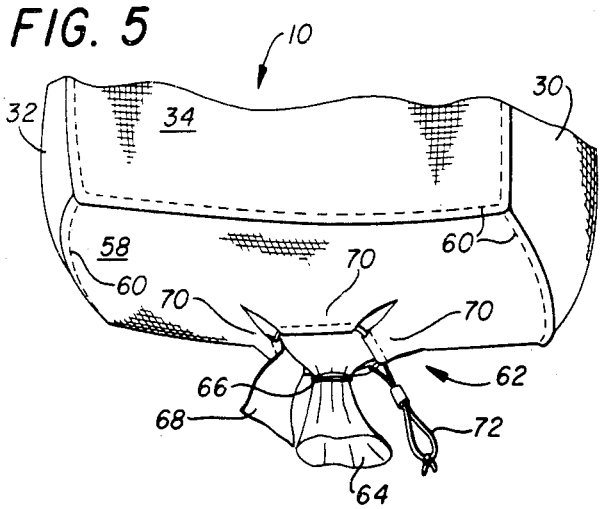
FIG. 5 is a partial perspective view of the bottom of the receptacle shown in FIG. 1 with the discharge spout assembly extended.
Figure 6A:
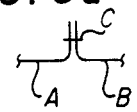
Figure 6B:
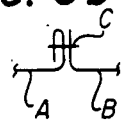
Figure 6C:
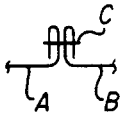

Referring now to FIGS. 1, 2 and 5, a bottom panel 58 closes the lower end of receptacle 10. Bottom panel 58 is secured about the periphery thereof by stitching 60 to the bottom edges of panels 30, 32, 34 and 36. The bottom panel 58 includes a discharge spout assembly 62. Discharge spout assembly 62 is substantially identical to the discharge spout assembly 70 illustrated and described in U.S. Pat. No. 4,143,796, the disclosure of which is herein incorporated by reference.

FIG. 1 illustrates discharge spout assembly 62 in the closed position, while FIG. 5 illustrates the assembly in the open and extended position. Briefly, discharge spout assembly 62 includes a spout 64 connected to an opening in bottom panel 58. Spout 64 is closed with a wire tie 66. When not in use spout 64 can be rolled up, covered with flap 68, and closed inside 70 by draw cord 72.

Collapsible receptacle 10 can be constructed of any suitably strong material which is flexible but substantially inextensible. Natural or synthetic woven material can be employed. Jute, cotton, polyethylene, or polypropylene are examples of such materials. It has been found that woven polypropylene material is advantageous because of its strength, durability and puncture resistance. An impermeable liner 74, shown in FIG. 1, can be provided inside receptacle 10, if desired. Liner 74 would be advantageous when handling foodstuffs, fine powdered materials, or moist materials. Polybutylene film, for instance, can be used for liner 74.

FIGS. *6a*, *6b*, *6c* and *6d* are detailed illustrations of seams which can be employed in connecting adjacent panels in receptacle 10. FIG. *6a* comprises a plain seam wherein single layers of panels A and B are connected by stitching C. In FIG. *6b* a double layer of panel A is secured to a single layer of panel B. Double layers of panels A and B are interconnected in FIGS. *6c* and *6d*. Panels A and B in these detailed illustrations represent any pair of adjacent panels in receptacle 10. If desired the outside edges of panels A and B can be fused or adhesively secured together to minimize leakage.

FIG. 7 partially illustrates a second embodiment of the invention. Various components of collapsible receptacle 80 are substantially identical in construction and function to components of collapsible receptacle 10 shown in FIGS. 1–5. Such identical components are designated in FIG. 7 with the same reference numerals, but are differentiated therefrom by means of a prime (′) designation.

The primary distinction comprises the fact that receptacle 80 does not include a discharge spout assembly, whereas receptacle 10 includes spout assembly 62. Bottom panel 56′ in receptacle 80 simply comprises a square or rectangular section of material. Discharge of flowable materials from receptacle 80 is accomplished by puncturing bottom panel 56′. Receptacle 80 is thus best suited for material handling applications wherein reuse of the receptacle is not contemplated. Though illustrated only partially, receptacle 80 is substantially identical to receptacle 10 in all other respects.

FIGS. 8–11 illustrate the steps involved in constructing the collapsible receptacle 90 shown in FIG. 12. Receptacle 90 comprises a third embodiment of the present invention. Receptacle 90 is formed from two panels 92 and 94 each having the configuration of an elongate rectangle. Panels 92 and 94 comprise suitable natural or synthetic material, such as woven polypropylene or woven polyethylene. Panel 92 includes an opening 96 near one end thereof. Panel 94 includes loops or sleeves 98 formed at the ends thereof. Sleeves 98 in panel 94 are formed by folding back and securing the ends of the panel with stitching 100. Preferably, a second line of stitching 102 is provided between stitching 100 and the end of each sleeve 98.

Figure 10:
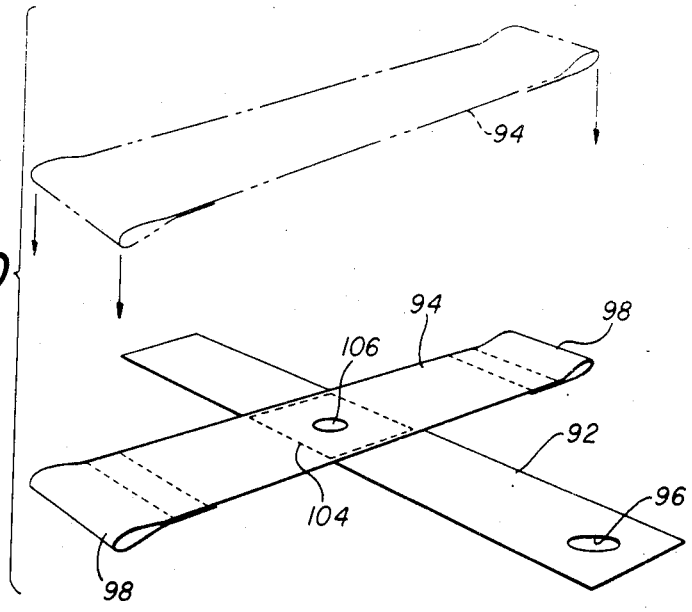

As shown in FIG. 10, panel 94 is laid over panel 92 and secured thereto with stitching 104. The area where panels 92 and 94 cross over comprises the bottom of receptacle 90. If desired, an opening 106 can be formed through panels 92 and 94 to receive a discharge spout assembly. A discharge spout assembly similar to spout assembly 62 in receptacle 10 can then be mounted in bottom opening 106.

Figure 11:
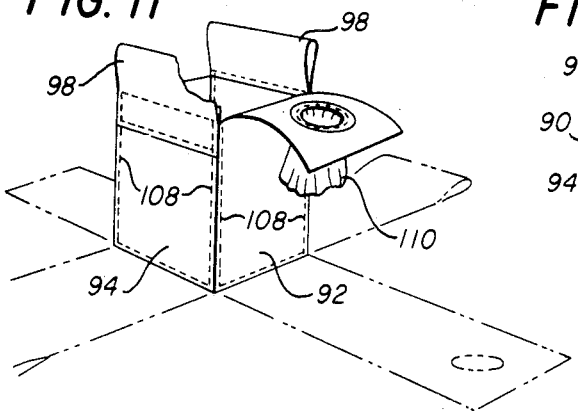

Panels 92 and 94 are folded inwardly and secured together along adjacent edges thereof by stitching 108, as is best shown in FIGS. 11 and 12. A fill spout 110 is then sewn into opening 96 in the upper portion of panel 92. This portion of panel 92 is then folded inwardly and secured about the periphery thereof by stitching 112 to the end panels 92 and 94. The top of receptacle 90 is thus closed in this manner. Any of the seam constructions illustrated in FIGS. *6a*, *6b*, *6c* or *6d* can be employed in constructing receptacle 90.

It will thus be apparent that collapsible receptacle 90 includes a bottom of double-layered construction. Receptacle 90 is comprised of two panels 92 and 94, each of which extends around the bottom of the receptacle for increased support. Lift sleeves 98 are connected by a continuous length of material uninterrupted by stitched seams.

Referring now to FIG. 13, there is shown a collapsible receptacle 120 incorporating a fourth embodiment of the invention. Various components of the fourth inventive embodiment are substantially identical in construction and function to components of the first embodiment, receptacle 10 shown in FIGS. 1–5. These identical components are designated in FIG. 13 with same reference numerals as utilized hereinbefore in connection with receptacle 10, but are distinguished therefrom by means of a double prime (″) designation.

The primary distinction between receptacle 120 and receptacle 10 comprises bands 122 in panels 34″ and 36″, the latter of which is not shown in FIG. 13. Preferably, each panel 34″ and 36″ includes two longitudinal bands 122 extending the entire length thereof and positioned near each side edge thereof. Panels 34″ and 36″ are preferably formed of woven polypropylene or woven polyethylene material, while bands 122 are each formed of continuous strands woven straight into each panel. For example, each band 122 can be about one to two inches wide, and be comprised of about 50 strands of polyester. Bands 122 can also be woven into panels 34″ and 36″ in the form of selvage. It has been found that bands 122 in receptacle 120 further enhance the integral sling construction of the receptacle.

Referring to FIGS. 14–18, collapsible receptacle 120 preferably includes bottom panel 124 having discharge spout assembly 126 mounted therein. The bottom of receptacle 120 is constructed as follows. Panel 124 is provided with a central opening 128. A round or oblong configuration can be utilized for opening 128. In accordance with the preferred construction of the invention, opening 128 is generally oval or oblong in configuration. The longest dimension of opening 128 should be greater than the maximum bridging distance of the particular material 12 to avoid clogging of discharge spout assembly 126. It has been found that clogging or material bridging across an opening depends upon the width of the opening rather than area. An oval opening 128 is thus preferable because material bridging can be avoided with a relatively small opening which does not weaken panel 124 as much as a round or larger area opening.

Figure 16:
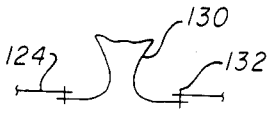

As shown in FIG. 16, a spout 130 is then secured in opening 128 by stitching 132. It will be appreciated that panel 124 with spout 130 could be utilized as the top panel 8" in receptacle 120.

Figure 17:
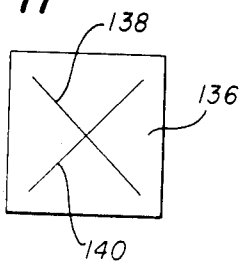
Figure 18:
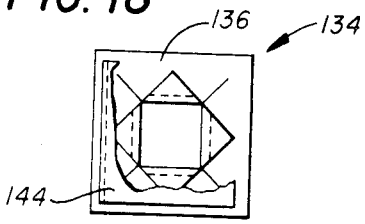

A closure subassembly 134, which is shown in FIGS. 17 and 18, is then secured over spout 130 to panel 124. Subassembly 134 includes another panel 136 which is relatively smaller than bottom panel 124. A pair of crosscuts 138 and 140 are formed through panel 136. Four flaps are thus formed by crosscuts 138 and 140. These flaps are next folded back and secured to panel 136, such as by means of sewing, to form guide loops for draw rope 142 shown in FIGS. 13 and 14. An optional cover flap 144 can then be sewn or otherwise secured to one side of panel 136 to complete construction of subassembly 134. The subassembly 134 is then attached to bottom panel 124 with stitching 146 to complete construction of discharge spout assembly 126.

It will be understood that the construction of panel 124 and discharge spout assembly 126 comprises a significant feature of the invention. This construction is not limited to receptacle 120, but can be employed in receptacle 10 or other receptacle constructions. The construction of this bottom panel begins with a panel/spout subassembly, which can be utilized by itself as a top panel. A bottom panel is formed simply by adding a closure subassembly 134 to panel 124. This facilitates the construction of both top and bottom panels. In addition, the use of subassembly 134 considerably reinforces panel 124 in the area surrounding spout 130 by eliminating high stress points at the corners of crosscuts 138 and 140.

FIGS. 19–22 illustrate the steps involved in constructing the collapsible receptacle 150 shown in FIG. 23. Receptacle 150 comprises a fifth embodiment of the invention herein. In contrast to the collapsible bags or receptacles shown in FIGS. 1–18, each of which is constructed from multiple pieces of suitable rectangular material, the receptacle 150 is constructed from a single piece of material. The method of constructing receptacle 150 can be adapted to automation and comprises a significant feature of this particular embodiment.

Figure 19:
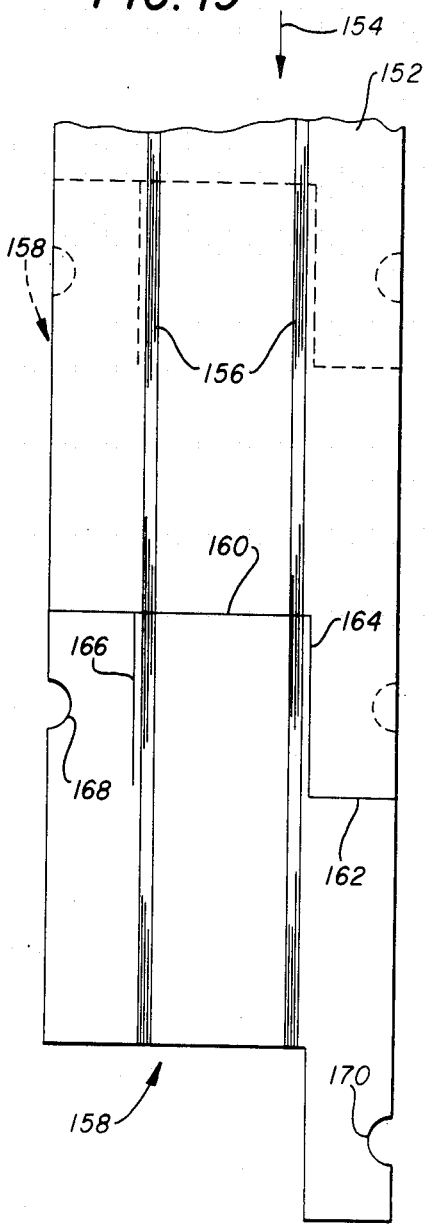

Referring to FIG. 19, a predetermined receptacle blank is first cut from a length of circular or tubular material 152. Suitable natural or synthetic material, such as woven polypropylene or woven polyethylene, can be used for material 152. Circular or tubular material 152 is in flattened condition and advanced from a supply thereof in the direction of arrow 154 into a cutting station. If desired, material 152 can include four integral reinforcing bands 156, only two of which are shown. Bands 156 are similar to bands 122 utilized in receptacle 120 described above. Each band 156, for example, comprises an area of one to two inch width with a plurality of continuous reinforcing strands extending in a longitudinal direction through material 152. Provision of bands 156 in material 152 enhances the integral sling construction of receptacle 150.

Receptacle blank 158 is cut from material 152 as follows. One transverse cut 160 extends inwardly from one edge of material 152 and across about $\frac{3}{4}$ of the width thereof. Another transverse cut 162 is made inwardly from the opposite edge of material 152 offset from cut 160 and across the remaining $\frac{1}{4}$ width of material 152. The ends of cuts 160 and 162 are connected by a longitudinal cut 164. Another longitudinal cut 166 intersects cut 160 at a point located at $\frac{1}{4}$ of the width of material 152 from the opposite edge thereof. Cuts 160, 162, 164 and 166 all extend through both layers of the flattened circular or tubular material 152.

It will be apparent that cut 166 remains in receptacle blank 158, while cuts 160–164 serve the purpose of severing the receptacle blank from material 152. Cuts 160, 162 and 164 define the upper end of the leading receptacle blank 158, and at the same time define the bottom end of the trailing receptacle blank. There is thus little or no material waste in forming each receptacle blank 158, which is one of the significant advantages of the fifth inventive embodiment herein.

In accordance with the preferred construction, two openings are then cut into the opposite longitudinal edges of receptacle blank 158. A generally semi-circular fill opening 168 is formed in the edge of receptacle blank 158 near cut 166. A generally semi-circular discharge opening 170 is preferably formed in the opposite edge of receptacle blank 158 at the bottom end thereof. Provision of opening 170 is optional and is not necessary if it is desired to construct receptacle 150 without a discharge spout.

Figure 20:
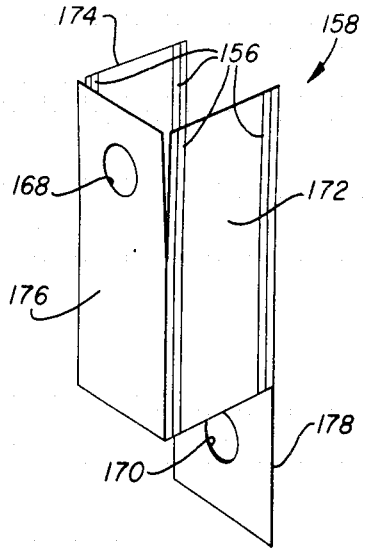

The tubular receptacle blank 158 is then opened as shown in FIG. 20. It will be observed that a pair of reinforcing bands 156 are provided in opposite panel portions 172 and 174 of the receptacle blank 158, while openings 168 and 170 are provided in the remaining pair of panel portions 176 and 178 thereof.

Figure 21:
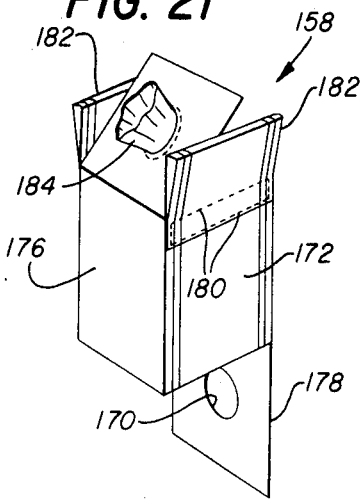

Referring to FIG. 21, the upper ends of panel portions 172 and 174 are then folded back and secured to themselves with at least one line of stitching 180 to form lift loops or sleeves 180. After formation of lift sleeves 182, a fill spout 184 is then sewn into opening 168 of panel portion 176 in receptacle blank 158. Installation of fill spout 184 is similar to that of spout 52 shown in FIG. 4.

Figure 22:
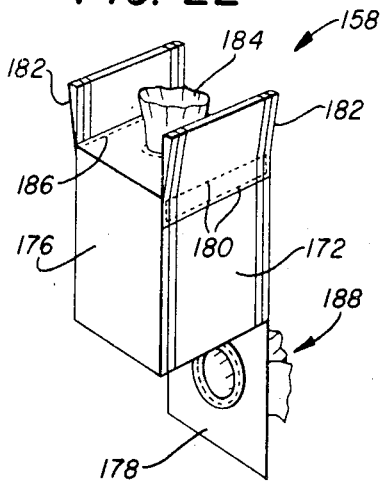

Referring to FIG. 22, the top end of panel portion 176 with fill spout 184 therein is then folded inwardly and secured about the periphery thereof by stitching 186 to panel portions 172 and 174. Closure of the top end of receptacle 150 is thus completed with this step. A conventional wire tie (not shown) can be used to close fill spout 184.

Referring to FIGS. 22 and 23, a discharge spout assembly 188 is next sewn into opening 170 in the lower end of panel portion 178. If desired, discharge spout assembly 188 can comprise simply a spout 190 and wire tie 192 installed in a fashion similar to fill spout 184.

FIGS. 24 and 25 illustrate the preferred construction of discharge spout assembly 188 in the open and extended position. A closure subassembly 134, which was previously described herein and shown in FIGS. 17 and 18, is secured to panel portion 178 around spout 190. The addition of closure assembly 134 reinforces the bottom of receptacle 150.

FIG. 26 illustrates a receptacle 200 forming a first modification of the receptacle 10. Various components of collapsible receptacle 200 are substantially identical in construction and function to components of the collapsible receptacle 10 shown in FIGS. 1–5. Such identical components are designated in FIG. 26 with the same reference numerals, but are differentiated therefrom by means of a triple prime (‴) designation.

The collapsible receptacle 200 is constructed of woven polyethylene or polypropylene material. It has been found that the number of stitches per unit length in stitchings 42‴ and 44‴ are critical to the strength of the lift sleeves 38‴ and 40‴. It has been found most effective to create the first line of stitching 42‴ with 3½ stitches per inch and spaced a distance x of approximately 6 inches downwardly along the side panels 34‴ and 36‴ from the second line of stitching 44‴ regardless of the length of side panels 34‴ or 36‴. It has been found most effective to make the second line of stitchings 44‴ at a density of 5 stitches per inch.

An increased number of stitches per unit length in securing woven polyethylene or polypropylene materials tends to weaken the materials by breaking and destroying the fibers in the weave. A density for the second line of stitching 44‴ of 5 stitches per inch somewhat weakens the material but has the significant advantage in forming a seam that is resistent to passage of fine and powdered materials. The coarser stitching of the stitching 42‴ at 3½ stitches per inch separated from the second line of stitching 44‴ has been found to provide the strongest attachment of the lift sleeves to the remainder of the receptacle while minimizing damage to the material itself by the stitch.

FIG. 27 is a detailed illustration of seams which can be employed in connecting adjacent panels in any of the collapsible receptacles discussed hereinbefore. The seam is particularly adapted for use when the panels A and B are formed of woven polyethylene or polypropylene materials. However, the seam may be equally as effective when using any suitably strong material which is flexible but substantially inextensible to construct the collapsible receptacle.

The edges of panels A and B to be secured together are doubled with the folded sections 202 and 204 of each panel extending adjacent the unfolded sections 206 and 208. A suitable glue 210 is placed between the folded and unfolded sections of each panel to form a double layer. The panels may then be secured together by a stitching C through the double layers of each of the panels. When the panels A and B are formed of woven polypropylene or polyethylene material, the doubled layers of the panels minimizes the effects of damage to the elements of the weave by the sewing of stitching C.

From the foregoing, it will be understood that the present invention comprises an improved collapsible receptacle having numerous advantages over the prior art. The receptacle herein utilizes a construction which serves as a built-in sling for the receptacle, thereby eliminating the complication and expense of an external sling arrangement. Other advantages will suggest themselves to those skilled in the art.

Although particular embodiments of the invention have been illustrated in the accompany Drawings and described in the foregoing Detailed Description, it will be understood that the invention is not limited to the embodiments disclosed, but is intended to embrace any alternatives, modifications, and rearrangements and/or substitutions of parts or elements as fall within the spirit and scope of the invention.

We claim:

1. A collapsible receptacle for handling flowable materials, which comprises:

a receptacle blank of predetermined configuration formed from a single piece of material;

said receptacle blank being folded to define four side panels each having top and bottom edges, a top panel and a bottom panel;

the top edges of two of the side panels in said receptacle blank being folded back and secured to form lift sleeves by which the receptacle can be supported;

the bottom panel in said receptacle blank being folded across and secured about the periphery thereof to the bottom edges of the side panels therein;

the top panel in said receptacle blank being folded between the lift sleeves and secured about the periphery thereof to the side panels therein; and fill spout means mounted in the top panel of said receptacle blank for introducing flowable material into the receptacle.

2. The receptacle of claim 1, wherein said receptacle blank is constructed of material selected from the group consisting of woven polypropylene and woven polyethlene materials.

3. The receptacle of claim 1, the blank is formed of woven materials, and further including:

a plurality of strands of reinforcing fibers extending continuously between the ends of the two side panels forming said lift sleeve.

4. The receptacle of claim 3, further including:

discharge spout means mounted in the bottom panel of said first piece for releasing flowable material from the receptacle.

5. In combination with a collapsible receptacle for handling flowable materials and having interconnected side panels defining a sidewall, a bottom panel construction which comprises:

a first panel with an oblong opening formed therein;

a flexible spout extending through the opening in said first panel and secured about one end thereof to said panel;

a second panel including intersecting crosscuts therein of predetermined lengths forming a plurality of flaps, said flaps being folded back to define an opening therebetween and secured to define a guideway at the end of each flap;

a spout cover connected along one end between the first and second panels and extending across the opening in said second panel;

said second panel being secured to said first panel so that said spout extends through the opening in the second panel; and a draw rope extending through the guideways formed by said flaps for selectively enclosing the spout between the first and second panels.

6. The bottom panel construction of claim 5, wherein the opening in said first panel is oval-shaped with a length no less than the bridging distance of the material being handled.

* * * * *